US010988983B1

(12) United States Patent
Chaffin

(10) Patent No.: US 10,988,983 B1
(45) Date of Patent: Apr. 27, 2021

(54) GARAGE SCREEN

(71) Applicant: Michael A. Chaffin, Wethersfield, CT (US)

(72) Inventor: Michael A. Chaffin, Wethersfield, CT (US)

( * ) Notice: Subject to any disclaimer, the term of this patent is extended or adjusted under 35 U.S.C. 154(b) by 0 days.

(21) Appl. No.: 16/899,988

(22) Filed: Jun. 12, 2020

(51) Int. Cl.
*E06B 9/52* (2006.01)
*E06B 9/54* (2006.01)
*E05D 13/00* (2006.01)

(52) U.S. Cl.
CPC ..... *E06B 9/54* (2013.01); *E05D 13/1215* (2013.01); *E05Y 2900/106* (2013.01); *E05Y 2900/136* (2013.01); *E06B 2009/524* (2013.01); *E06B 2009/527* (2013.01)

(58) Field of Classification Search
CPC ..... A62C 2/16; E06B 9/54; E06B 2009/524; E06B 2009/527; E06B 9/52; E05D 13/1215; E05Y 2900/136; E05Y 2900/106
See application file for complete search history.

(56) References Cited

U.S. PATENT DOCUMENTS 1,708,377 A * 4/1929 Cornell ..... A62C 2/16 160/9
2,138,564 A * 11/1938 Barrow ..... E06B 9/54 160/281
3,090,426 A * 5/1963 Carlo ..... E06B 9/08 160/25
3,877,525 A * 4/1975 Husson ..... A62C 2/10 169/48
4,237,956 A * 12/1980 Sivin ..... E06B 9/40 160/120
4,846,241 A 7/1989 Chomka et al.
4,976,302 A * 12/1990 Taylor ..... E06B 9/68 160/310
5,056,839 A * 10/1991 Yoon ..... B60J 11/02 150/166
5,195,594 A * 3/1993 Allen ..... A62C 2/10 160/243
5,392,835 A * 2/1995 Wildt ..... E06B 9/17007 160/120

(Continued)

OTHER PUBLICATIONS

SolarRoll Motorized Garage Door Screens. Product Listing [online]. © Copyright 2020 RollShield. [retrieved on Nov. 25, 2019]. Retrieved from the Internet: <URL: https://rollshield.com/Product/garage-door-screens/>.

(Continued)

*Primary Examiner* — Daniel P Cahn
(74) *Attorney, Agent, or Firm* — Cramer Patent & Design, PLLC; Aaron R. Cramer

(57) ABSTRACT

A retractable dual screen system provides auxiliary environmental protection for garage door openings. An upper housing is mounted on an exterior of a garage door, including two rollers and is accessible for maintenance or repair by a removable cover. A first roller is a vinyl insect screening, and a second roller contains polyolefin material to provide an additional layer of insulation to help reduce heat loss and gain through the garage door. The second roller also provides a vapor barrier to help protect the garage door against high winds. A dual track system selectively allows both rollers to be independently deployed over the garage door opening.

11 Claims, 6 Drawing Sheets

(56) References Cited

U.S. PATENT DOCUMENTS

| | | | | |
|---|---|---|---|---|
| 5,605,185 | A * | 2/1997 | McKeon | A62C 2/10 160/1 |
| 5,787,952 | A * | 8/1998 | Wegner | E06B 9/54 160/100 |
| 6,296,040 | B1 * | 10/2001 | Schaap | E06B 9/54 160/23.1 |
| 6,705,378 | B1 * | 3/2004 | Smidt | E06B 9/54 160/113 |
| 7,086,442 | B1 | 8/2006 | Esparza | |
| 7,299,848 | B2 * | 11/2007 | Streib | A62C 2/247 160/243 |
| 7,308,926 | B1 | 12/2007 | Hawkins | |
| 7,730,924 | B2 * | 6/2010 | Ito | E04F 10/0692 160/55 |
| 8,151,858 | B2 | 4/2012 | Hughes et al. | |
| 8,499,393 | B2 * | 8/2013 | Ballester | B65G 69/2876 14/71.1 |
| 9,605,474 | B1 * | 3/2017 | McCauley | E06B 9/40 |
| 9,850,703 | B1 | 12/2017 | Alirezaei | |
| 2003/0066252 | A1 * | 4/2003 | Rejc | F25D 23/021 52/173.2 |
| 2013/0048229 | A1 * | 2/2013 | Dwarka | E06B 9/26 160/121.1 |
| 2015/0151425 | A1 * | 6/2015 | Bonini | E06B 9/54 160/120 |
| 2016/0319593 | A1 * | 11/2016 | Dwarka | E06B 9/262 |
| 2017/0211315 | A1 * | 7/2017 | Fleischman | E04B 1/0046 |
| 2019/0153774 | A1 * | 5/2019 | Balay | E06B 9/0638 |

OTHER PUBLICATIONS 16 ft. x 7 ft. 2-Zipper Garage Door Screen. Product Listing [online]. © 2000-2020 Home Depot Product Authority, LLC. [retrieved on Nov. 25, 2019]. Retrieved from the Internet: <URL: https://www.homedepot.com/p/Fresh-Air-Screens-16-ft-x-7-ft-2-Zipper-Garage-Door-Screen-1231-C-167/202898578>.

16 ft. x 7 ft. 3-Zipper Garage Door Screen with Rope/Pull. Product Listing [online]. © 2000-2020 Home Depot Product Authority, LLC. [retrieved on Nov. 25, 2019]. Retrieved from the Internet: <URL: https://www.homedepot.com/p/Fresh-Air-Screens-16-ft-x-7-ft-3-Zipper-Garage-Door-Screen-with-Rope-Pull-1231-D-167-RP/202898581>.

* cited by examiner

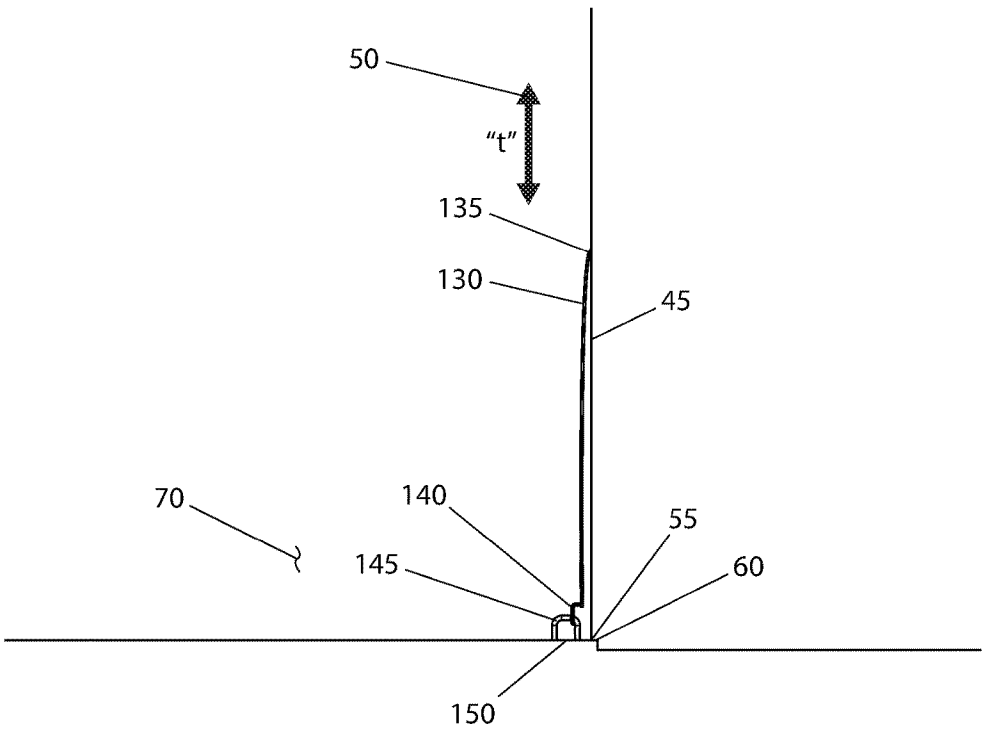
FIG. 6
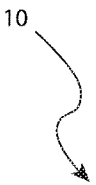

GARAGE SCREEN

RELATED APPLICATIONS

None.

FIELD OF THE INVENTION

The presently disclosed subject matter is directed to a screen and more specifically to a garage screen.

BACKGROUND OF THE INVENTION

People use their garages to perform a variety of functions, other than the typical storage purposes, ranging from a place to do small jobs, hobbies, etc. to a place to sit and enjoy warm summer weather. During the times when people occupy this space, they typically leave the large garage door opened in order to receive fresh air and sunlight. In doing so, however, the space inside the garage is exposed to access by anyone and everything outside, including common insects such as flies, mosquitoes, gnats and the like.

Additionally, garage doors can be subjected to a wide variety of potentially dangerous environmental elements such as temperature extremes, wind, ice, rain, and the like, which, even if not resulting in costly damage, can shorten their useful life. Finally, should the garage be heated in winter months, the heat loss through a standard garage door can be excessive. Accordingly, there exists a need for a means by which garage doors and garage door openings can be protected against the physical dangers as described above. The development of the garage screen fulfills this need.

SUMMARY OF THE INVENTION

The principles of the present invention provide for a garage door protective device which comprises a head assembly which is arranged in a horizontal manner along a top door jamb. The head assembly is attached to the top door jamb with a first plurality of fasteners. The garage door protective device also comprises a pair of sidetrack assemblies which are mounted on each of a pair of side door jambs by a second plurality of fasteners, a protective first layer which extends from the head assembly by pulling it downward until a leading edge contacts a threshold and a second layer which is located behind the first layer. The second layer is manually pulled out of the head assembly.

The garage door protective device also comprises a rear housing surface which is placed flush against the single car garage door; and a swing open cover attached via a hinge. The swing open cover moves along a cover travel path and allows access to the interior of the head assembly as well as to both the first layer spring loaded roller and the second layer spring loaded roller. The garage door protective device also comprises a strap which is attached to the first layer via an attachment means.

The interior of the head assembly may house a first layer spring loaded roller and a second layer spring loaded roller. Each of the sidetrack assemblies may include a backplane with three perpendicular flanges. The three perpendicular flanges may provide for a pair of channel cavities. The pair of channel cavities may include a first channel cavity that holds and guides the first layer and a second channel cavity that holds and guides the second layer. The holding and guidance afforded by the three perpendicular flanges may assist in keeping the first layer and/or the second layer aligned and in place. The first layer may provide an additional layer of insulation for the single car garage door to help reduce heat loss and gain through the single car garage door.

The first layer may include a graphic image. The first layer may act as a vapor barrier and protects the single car garage door against high winds. The first layer may be made of polyolefin. The second layer may be made from vinyl insect screening to allow for air flow into the garage interior while protecting against insect entry. The rear housing surface may not be attached to the single car garage door because of the movable nature of the single car garage door. A lower point of the strap may be provided with a hook portion which may engage a loop portion in a floor anchor point.

Restraint may be provided by the hook portion and the loop portion to prevent inadvertent retraction of the first layer. The strap may be made of nylon. The garage door protective device may be mounted on the exterior side of a single car garage door and may provide enhanced environmental protection for the single car garage door and enhance the environmental conditions on an interior of a garage. The first layer may be in the range of 20 mils to 30 mils thick. The garage may be a new garage or an existing garage.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

10. Garage Door Protective Device
15. Garage
20. Single Car Garage Door
25. Head Assembly
30. Top Door Jamb
35. Side Track Assembly
40. Side Door Jamb
45. First Layer
50. Travel Path "t"
55. Leading Edge
60. Threshold

62. Graphic Image
65. Second Layer
70. Garage Interior
75. Garage Door Opening
80. Fasteners
85. Rear Housing Surface
90. First Layer Spring Loaded Roller
95. Second Layer Spring Loaded Roller
100. Swing Open Cover
105. Hinge
110. Cover Travel Path "S".
115. Backplane
120. Flange
125. Channel Cavity
130. Strap
135. Means For Attaching
140. Hook
145. Loop
150. Floor Anchor Point

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Figure 1:
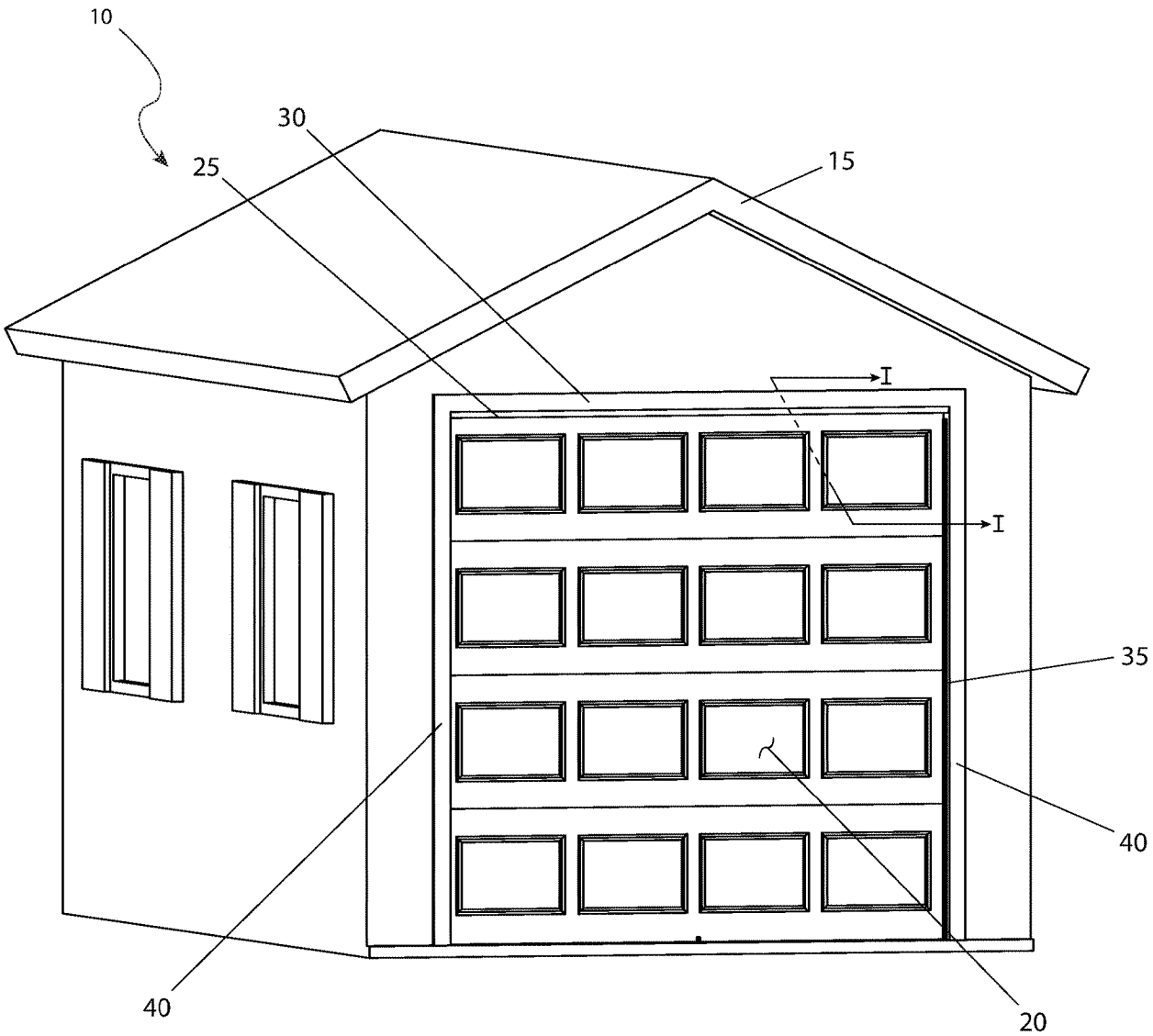
FIG. 1 is a perspective view of the garage door protective device, installed on a garage, shown in a fully retracted state, according to the preferred embodiment of the present invention.

Referring now to FIG. 1, a perspective view of the garage door protective device 10, installed on a garage 15, shown in a fully retracted state, according to the preferred embodiment of the present invention is disclosed. The garage door protective device 10 (herein also described as the "device") 10, is mounted on the exterior side of a single car garage door 20 and provides enhanced environmental protection for the single car garage door 20 as well as enhances environmental conditions on the interior of the garage 15. The device 10 would be installed on existing garage 15 as well as new garage 15 that have been recently constructed. The device 10 provides for a head assembly 25 that is arranged in a horizontal manner along the top door jamb 30 as well as two (2) side track assemblies 35 mounted on each of the two (2) side door jambs 40. While the exact dimensions of the device 10 are not intended to be a limiting factor of the present invention, typical dimensions for use on a single car garage door 20 would be approximately one-hundred-eight inches (108 in.) wide and eighty-four inches (84 in.) tall.

Figure 2:
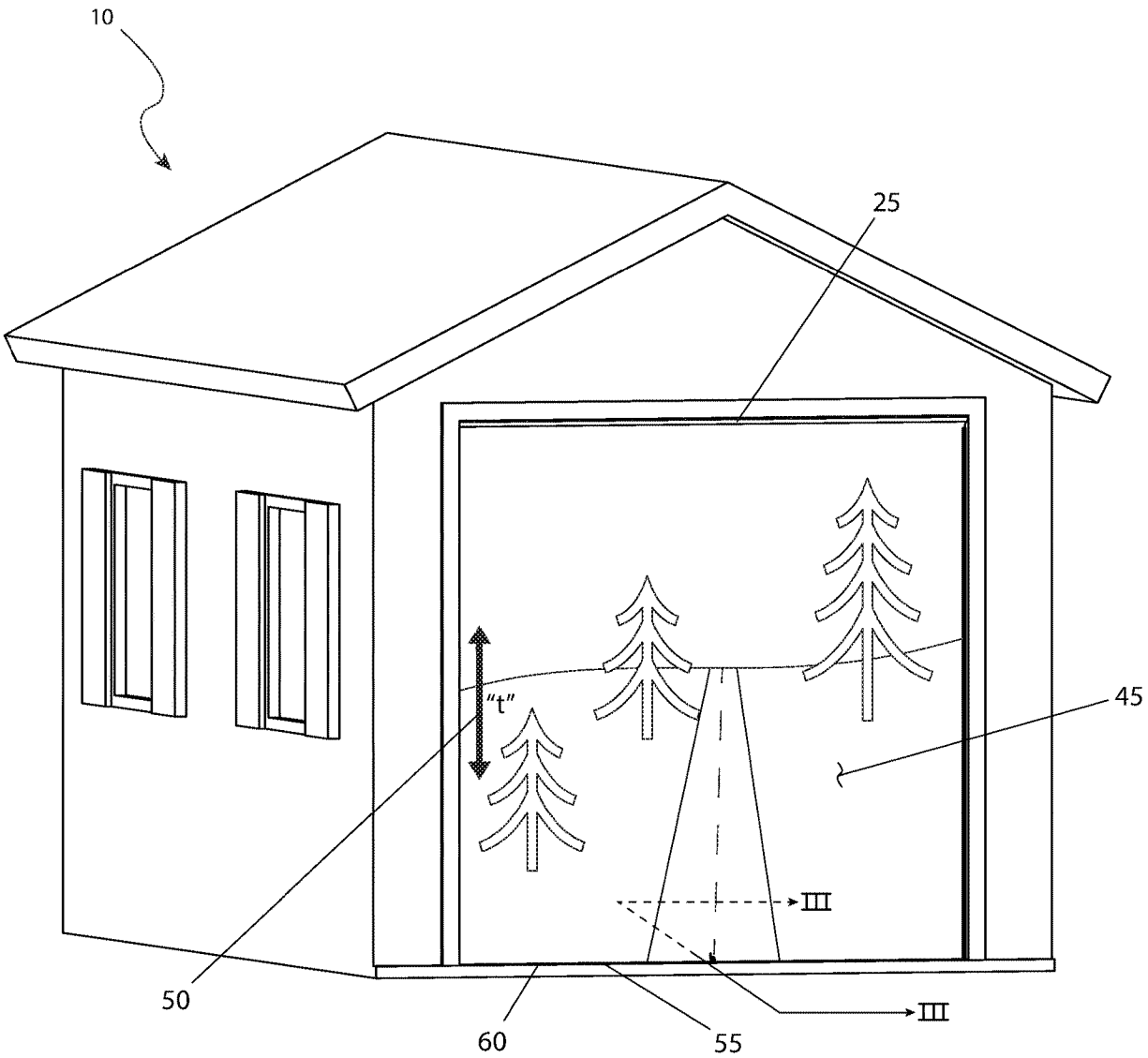
FIG. 2 is a perspective view of the garage door protective device, installed on a garage, shown in a fully extended, according to the preferred embodiment of the present invention.

Referring next to FIG. 2, a perspective view of the device 10, installed on a garage 15, shown in a fully extended, according to the preferred embodiment of the present invention is depicted. This view provides knowledge of a protective first layer 45 which has been completely extended from the head assembly 25, by pulling it along a travel path "t" 50 in much the same manner as a window shade. This first layer 45 is pulled downward until a leading edge 55 contacts a threshold 60. The first layer 45 is envisioned to be made of a polyolefin material that is approximately twenty to thirty mils (20-30 mils) thick. The first layer 45 would be used during weather extremes to provide an additional layer of insulation for the single car garage door 20 (as shown in FIG. 1) to help reduce heat loss and gain through the single car garage door 20. The first layer 45 would also aid as a vapor barrier and help protect the single car garage door 20 against high winds. The first layer 45 is provided with a graphic image 62, the nature of which can be chosen at the time of purchase. It is envisioned that possible images include landscape pictures (as shown), corporate symbols, sport team logos, decorative patterns, cartoon characters, photographs, solid colors, or the like. The exact nature of the graphic image 62 is not intended to be a limiting factor of the present invention.

Figure 3:
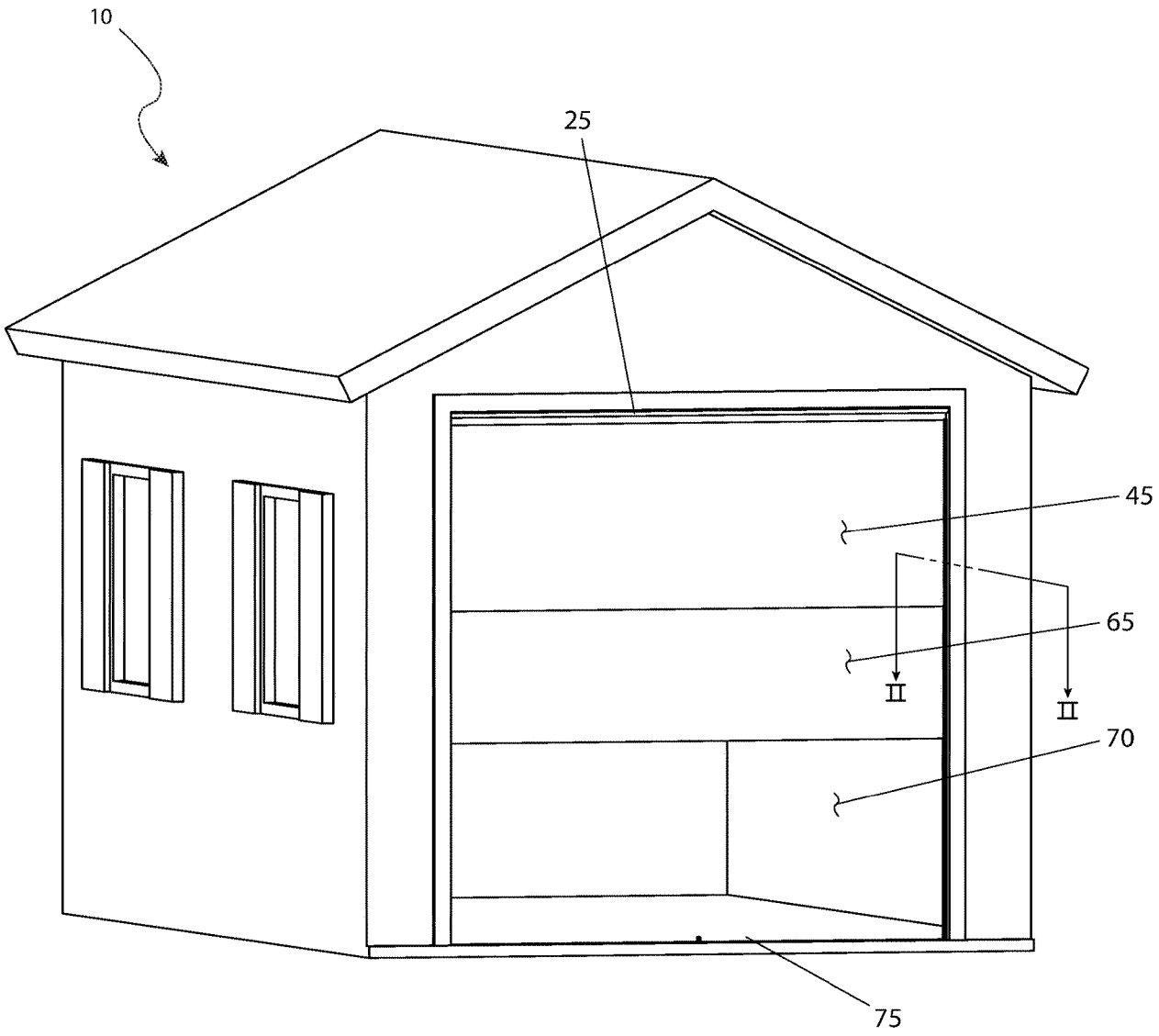
FIG. 3 is a perspective view of the garage door protective device, installed on a garage, shown in a partially extended state, according to the preferred embodiment of the present invention.

Referring now to FIG. 3, a perspective view of the device 10, installed on a garage 15, shown in a partially extended state, according to the preferred embodiment of the present invention is shown. This view provides a depiction of a second layer 65 located behind the first layer 45. Additionally, the single car garage door 20 (as shown in FIG. 1) is in a raised state, thus exposing a garage interior 70 along the lower portion of a garage door opening 75. As before, the second layer 65 is manually pulled out of the head assembly 25. It is envisioned that the second layer 65 would be made from vinyl insect screening, which would be used during warm weather to allow for air flow into the garage interior 70, but protect against insect entry.

Figure 4:
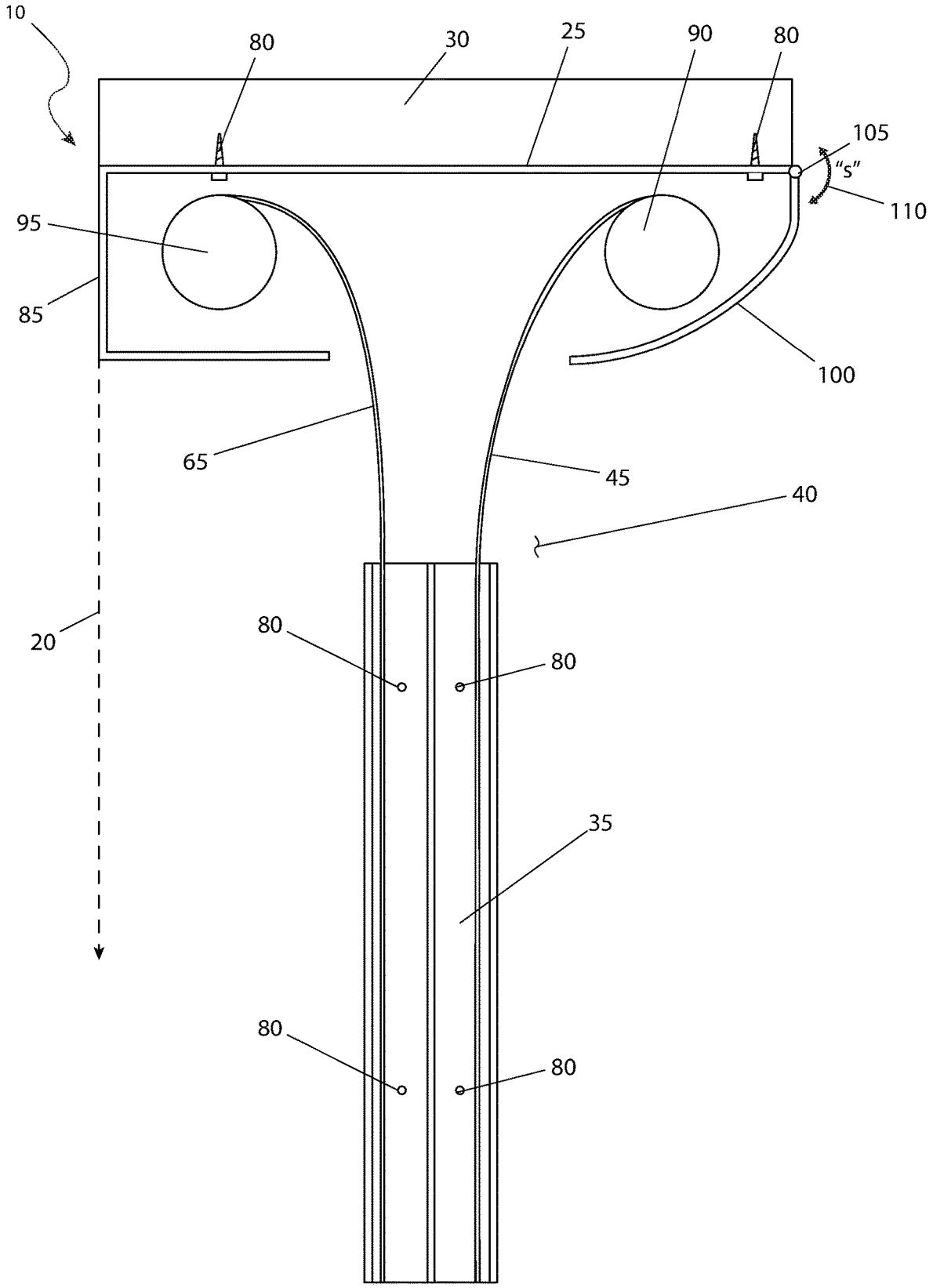
FIG. 4 is a sectional view of the garage door protective device, shown along a line I-I, as seen in FIG. 1, according to the preferred embodiment of the present invention.

Referring next to FIG. 4, a sectional view of the device 10, shown along a line I-I, as seen in FIG. 1, according to the preferred embodiment of the present invention is disclosed. The head assembly 25 is physically attached to the top door jamb 30 via multiple fasteners 80 (two (2) of which are shown in FIG. 4 for purposes of illustration), such as screws. The rear housing surface 85 is placed flush against the single car garage door 20, but is not attached, due to the movable nature of the single car garage door 20. The interior of the head assembly 25 houses a first layer spring loaded roller 90 and a second layer spring loaded roller 95, both similar in nature to a spring-loaded window shade. A swing open cover 100 is attached via a hinge 105 and moves along a cover travel path "s" 110. This action allows access to the interior of the head assembly 25 as well as to both the first layer spring loaded roller 90 and the second layer spring loaded roller 95 for purposes of maintenance and/or repair. An individual side track assembly 35 is visible as well and is mounted against a side door jamb 40, also by multiple fasteners 80, four (4) of which are shown for purposes of illustration.

Figure 5:
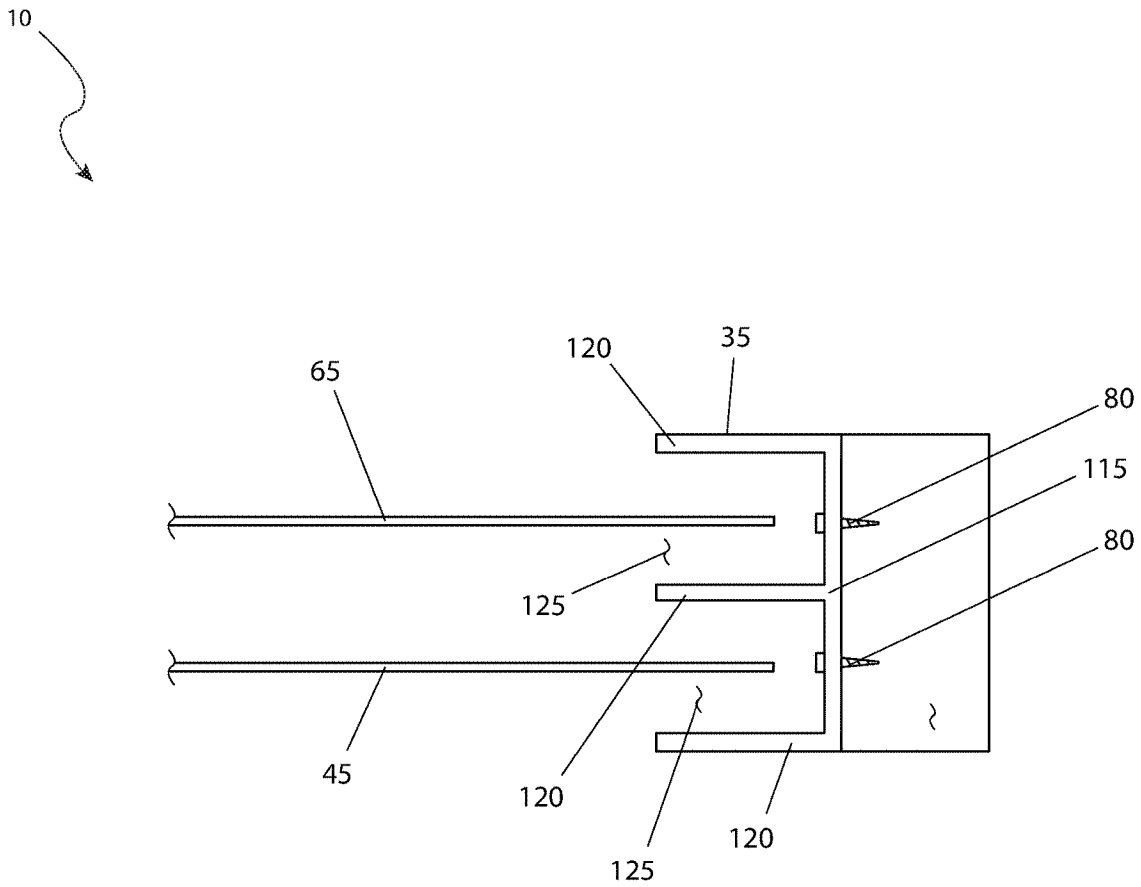
FIG. 5 is a sectional view of the garage door protective device, shown along a line II-II, as seen in FIG. 3, according to the preferred embodiment of the present invention; and, FIG. 6 is a sectional view of the garage door protective device, shown along a line III-III, as seen in FIG. 2, according to the preferred embodiment of the present invention.

Referring now to FIG. 5, a sectional view of the garage door protective device 10, shown along a line II-II, as seen in FIG. 3, according to the preferred embodiment of the present invention is depicted. This view further describes the configuration of the side track assemblies 35. Each side track assembly 35 comprises a backplane 115 with three (3) perpendicular flanges 120. As aforementioned described, the side track assemblies 35 are mounted to the side door jambs 40, by multiple fasteners 80, two (2) of which are shown for purposes of illustration. The three (3) side track assemblies 35 provides for two (2) channel cavities 125, one (1) of which holds and guides the first layer 45 and the other holds and guides the second layer 65. The holding and guidance afforded by the flanges 120 assists in keeping the first layer 45 and/or the second layer 65 aligned and in place during high winds, storms, or similar events.

Referring to FIG. 6, a sectional view of the garage door protective device 10, shown along a line III-III, as seen in FIG. 2, according to the preferred embodiment of the present invention is shown. The first layer 45 is shown in a down or extended position with the leading edge 55 contacting the threshold 60. A strap 130, made of conventional nylon strapping material, is attached to the first layer 45 at the center point thereof (both center of height and center of width) via a means for attaching 135 such as stitching, adhesive, mechanical fosters, rivets, or the like. The exact means for attaching 135 is not intended to be a limiting factor of the present invention. The lower point of the strap 130 is provided with a hook 140 which engages a loop 145 in a floor anchor point 150. The restraint provided by the hook 140 and loop 145 prevent inadvertent retraction of the first layer 45. While not shown, those skilled in the art, that the configuration provided by the strap 130, the means for attaching 135, and the hook 140 will be duplicated with the screen layer 65 (as shown in FIG. 4). The action of grasping the strap 130 and pulling it along the travel path "t" 50, occurs with the user standing in the garage interior 70.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 6. The user would procure the device 10 from conventional procurement channels such as hardware stores, home improvement stores, mechanical supply houses, mail order and internet supply houses and the like. Special attention would be paid to the overall size of the device 10, color of the head assembly 25, the graphic image 62 printed on the first layer 45, method of installation, and the like.

After procurement and prior to utilization, the device 10 would be installed in the following manner: the head assembly 25 would be installed to the top door jamb 30 using fasteners 80; next, the side track assemblies 35 would be attached to the side door jambs 40 using fasteners 80; the floor anchor point 150 would be attached to the threshold 60 at the midpoint of the garage door opening 75; at this point in time, the first layer 45 and the second layer 65 would be tested for proper operation as shown in FIG. 3 and FIG. 6. It is envisioned that the device 10 can be installed at the time of initial construction of the garage 15 or at any time afterwards in a retrofit kit configuration. Due to the simple nature of installation, it is envisioned that the device 10 could be installed by a professional contractor or the owner of the garage 15 in a do-it-yourself manner.

During utilization of the device 10, the following procedure would be initiated: should warm weather be experienced and the user wishes to protect the garage interior 70 from insects and other contaminants, the second layer 65 would be pulled down along the travel path "t" 50 with the outer edges contained withing the side track assemblies 35 via the respective strap 130; the hook 140 on the strap 130 would be attached to the loop 145 of the floor anchor point 150 thus securing it in a down position. Should inclement weather be experienced and the user wishes to protect the single car garage door 20 and the garage interior 70 from extreme temperatures, UV radiation, insects and other contaminants, the second layer 65 would be pulled down along the travel path "t" 50 with the outer edges contained withing the side track assemblies 35 via the respective strap 130; the hook 140 on the strap 130 would be attached to the loop 145 of the floor anchor point 150 thus securing it in a down position. To release either the first layer 45 or the second layer 65 the above process would be reversed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A garage screen, comprising:

a head assembly arranged in a horizontal manner along a top door jamb, the head assembly is attached to the top door jamb with a first plurality of fasteners;

a pair of sidetrack assemblies mounted on each of a pair of side door jambs by a second plurality of fasteners;

a protective first layer extended from the head assembly when the protective first layer is pulled downward until a leading edge contacts a threshold;

a second layer located behind the first layer when the second layer is manually pulled out of the head assembly;

a rear housing surface placed flush against a single car garage door of a garage;

a swing open cover attached via a hinge, wherein the swing open cover is configured to move along a cover travel path to allow access to an interior of the head assembly as well as to a first layer spring loaded roller and a second layer spring loaded roller; and a strap attached to the first layer via a means for attaching;

wherein an interior of the head assembly houses the first layer spring loaded roller and the second layer spring loaded roller;

wherein the first layer provides an additional layer of insulation for the single car garage door to help reduce heat loss and gain through the single car garage door;

wherein the first layer is a vapor barrier and protects the single car garage door against wind; and wherein the second layer is made from vinyl insect screening to allow for air flow into a garage interior while protecting against insect entry.

2. The garage screen, according to claim 1, wherein each of the sidetrack assemblies include a backplane with three perpendicular flanges.

3. The garage screen, according to claim 2, wherein the three perpendicular flanges provide for a pair of channel cavities.

4. The garage screen, according to claim 3, wherein the pair of channel cavities includes a first channel cavity configured for holding and guidance of the first layer and a second channel cavity configured for holding and guidance of the second layer.

5. The garage screen, according to claim 4, wherein the holding and guidance afforded by the three perpendicular flanges keeps the first layer and/or the second layer aligned and in place.

6. The garage screen, according to claim 1, wherein the first layer includes a graphic image.

7. The garage screen, according to claim 1, wherein the first layer is made of polyolefin.

8. The garage screen, according to claim 1, wherein the strap is made of nylon.

9. The garage screen, according to claim 1, wherein a garage door protective device is mounted on an exterior side of the single car garage door and provides enhanced environmental protection for the single car garage door and enhances environmental conditions on an interior of the garage.

10. The garage screen, according to claim 1, wherein the first layer is 20 mils to 30 mils thick.

11. The garage screen, according to claim 1, wherein the means for attaching is selected from the group consisting of: a plurality of stitching, an adhesive, one or more mechanical fasteners, and one or more rivets.

* * * * *